US005147217A

United States Patent [19]

Neale, III et al.

[11] Patent Number: 5,147,217

[45] Date of Patent: Sep. 15, 1992

[54] ELECTRICAL COMPONENT PACKAGE

[75] Inventors: Frank T. Neale, III, Niles; Detlev H. Von Schwerdtner, Hudson; John A. Yurtin, Southington, all of Ohio

[73] Assignee: General Motors Corporation, Detroit, Mich.

[21] Appl. No.: 716,736

[22] Filed: Jun. 18, 1991

[51] Int. Cl.[5] ..... H01R 4/24

[52] U.S. Cl. ..... 439/403

[58] Field of Search ..... 439/389–425

[56] References Cited

U.S. PATENT DOCUMENTS 4,981,443 1/1991 Suverison et al. ..... 439/398

*Primary Examiner*—Joseph H. McGlynn

*Attorney, Agent, or Firm*—Francis J. Fodale

[57] ABSTRACT

An electrical component package comprises an insulator housing of thermoplastic material having a hollow base and a cover. The hollow base supports and locates an electrical component longitudinally in a component cavity and holds and positions the component leads in terminal cavities at opposite longitudinal ends of the component cavity. Insulation displacement terminals are then inserted into the terminal cavities establishing electrical connections with the positioned component leads. The hollow base is then partially filled with a sealant material after which the electric component package is installed on a pair of electric cables by closing the cover to push the electric cables down into insulation displacement slots of the respective terminals.

20 Claims, 2 Drawing Sheets

ELECTRICAL COMPONENT PACKAGE

BACKGROUND OF THE INVENTION

This invention relates generally to electrical component packages and more specifically to electrical component packages that are capable of being attached to a pair of insulated electrical wires.

U.S. Pat. No. 4,822,299 granted to Frederick H. Rider, Jr. Apr. 18, 1989 discloses such an electrical component package in which an electrical component is packaged in an insulator housing that has insulation displacement terminals and operating members to facilitate field assembly to insulated electrical wires.

U.S. Pat. No. 3,865,460 granted to Thomas M. Cherney and John O. Knudson Feb. 11, 1975 also discloses electrical component packages in which an electrical component is packaged in an insulator housing that has insulation displacement terminals to connect the electrical component to a pair of insulated electrical wires.

SUMMARY OF THE INVENTION

The object of this invention is to provide an improved electrical component package of the above noted type.

A feature of the invention is that the electrical component is preloaded into the insulator housing providing strain relief and precision alignment of the electrical component leads for electrical connection to the subsequently assembled insulation displacement terminals.

Another feature of the invention is that insulation displacement terminals are connected to the electrical component leads before the electrical component package is assembled to the insulated electrical wires so that the connection, polarity, and function of the electrical component can be checked both before and after application of a sealant.

Another feature of the invention is that the insulator housing provides integral strain relief from external applied forces via integrated wire clamping rails and towers of the insulator housing cover and base.

Another feature of the invention is that the insulator housing base is configured to reduce the volume of the electrical component cavity and the insulator housing cover is provided with displacement ribs and alignment walls to reduce the amount of sealant required.

Yet another feature of the invention is that the insulator housing has sealant dams that are configured to assist in cradling and centering insulated electrical wires to facilitate the insulated electrical wires being forced into the insulation displacement slots of terminals disposed in the insulator housing.

Yet another feature of the invention is that the insulator housing has sealant dams that are configured to break outwardly when the wires are forced into the insulation displacement slots of the terminal disposed in the insulator housing.

Still yet another feature of the invention is that the cover is retained on the base of the insulator housing in a partially closed position to facilitate full closure with an assembly tool.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
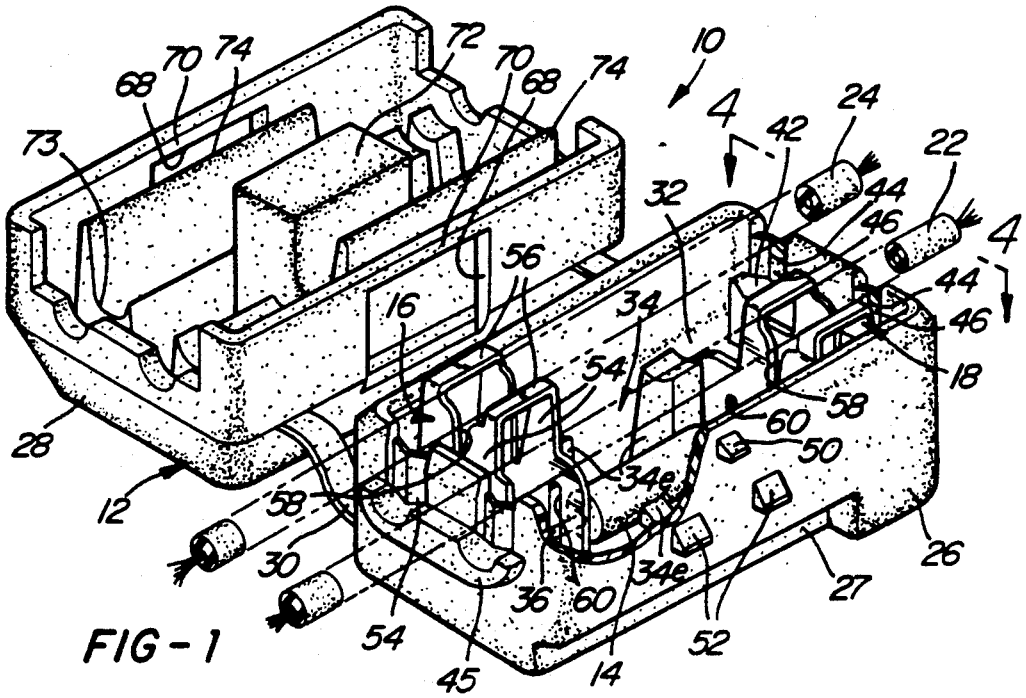
FIG. 1 is a perspective view of an electrical component package in accordance with the invention showing the cover in an open position and the base of the insulator housing positioned for attachment to a pair of insulated electrical wires.

Referring now to the drawing, an electrical component package 10 in accordance with this invention comprises an insulator housing 12, an electrical component 14 (such as a diode, capacitor, resistor or the like), a pair of insulation displacement terminals 16, 18 and a sealant material 20. The electrical component package 10 is adapted for assembly to a pair of insulated electric wires or cables 22, 24 such as would be found in an automotive wiring harness for example.

Figure 2:
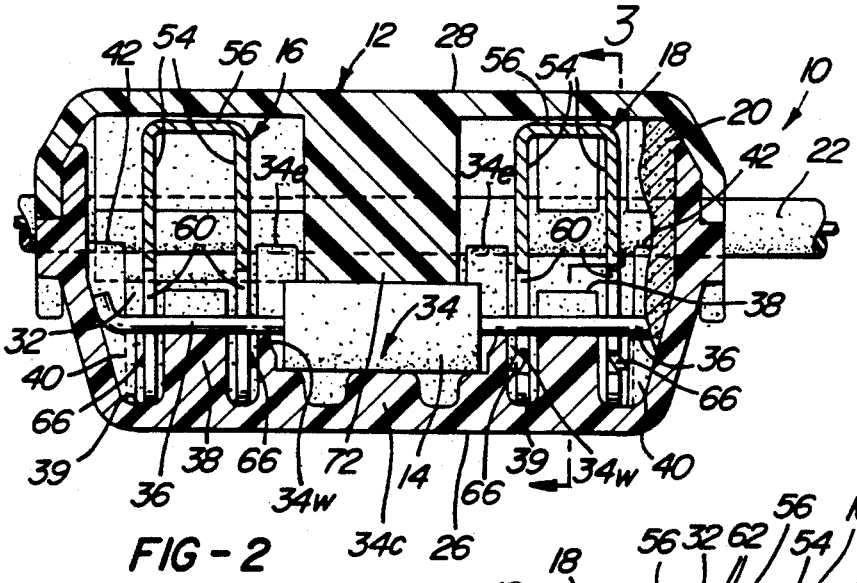
FIG. 2 is a longitudinal section of the electrical component package of FIG. 1 showing the cover in a fully closed position firmly attaching the electrical component package to the pair of insulated electrical wires.
Figure 3:
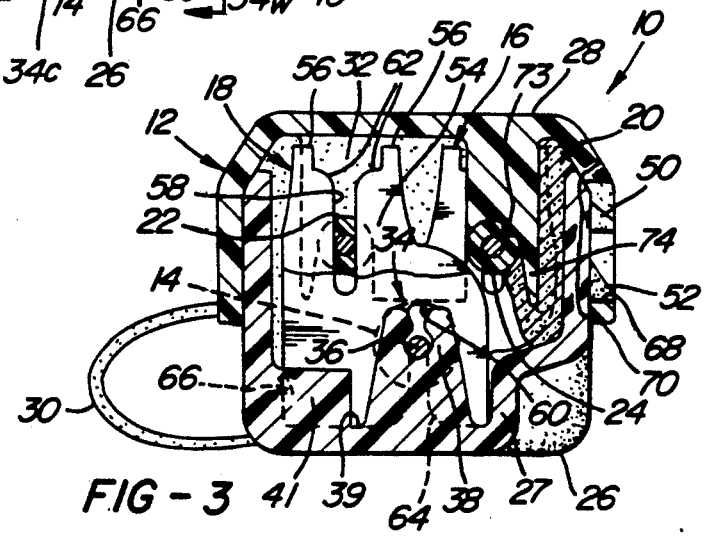
FIG. 3 is a section taken substantially along the line 3—3 of FIG. 2 looking in the direction of the arrows.
Figure 6:
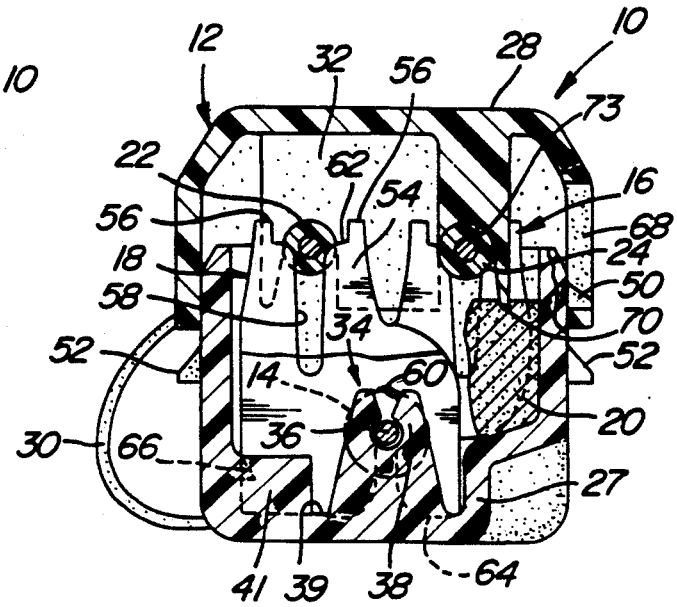
FIG. 6 is a section taken substantially along the line 6—6 of FIG. 5 looking in the direction of the arrows.
Figure 5:
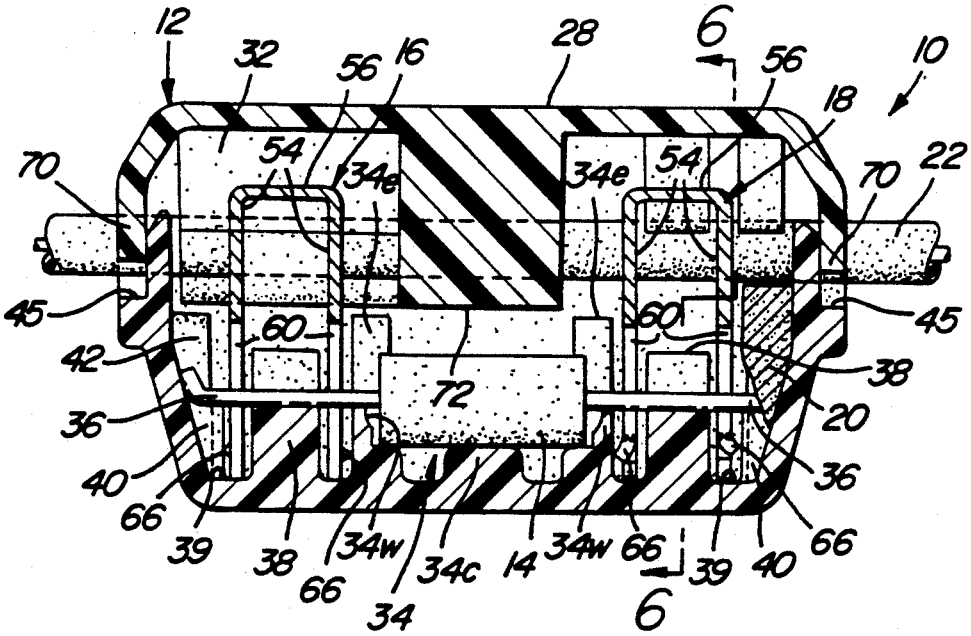
FIG. 5 is a longitudinal section of the electrical component package of FIG. 1 showing the cover in a partially closed position to facilitate full closure and firm attachment of the electrical component package to the pair of insulated electrical wires with an assembly tool.

The insulator housing 12 is molded of a thermoplastic material and comprises a lower housing portion or hollow base 26 and an upper housing portion or cover 28 that is integrally attached to the hollow base 26 by strap portions 30. The bottom of the hollow base 26 has a component cavity 32 that is reduced in volume by offsetting the side walls 27 inwardly toward each other as best shown in FIGS. 1, 3 and 6. The component cavity 32 includes mean for supporting and locating the electrical component 14 longitudinally in the component cavity 32 in the form of a generally U-shaped cradle 34. The U-shaped cradle 34 comprises a central member **34*c* and end members 34*e* of increased height that include their short end walls 34*w* as best shown in FIGS. 1, 2 and 5**.

The hollow base 26 also has means for holding and positioning the leads 36 of the electrical component 14 that is supported in the U-shaped cradle 34. This means for holding and positioning the leads 36 comprises the cradle end walls **34*w* and slotted lead clips 38 and supports 40 that are longitudinally spaced from each other in alignment with the cradle 34 and disposed in terminal cavities 39 at each end of the cradle 34. The cradle end walls 34*w*, lead clips 38 and supports 40 position the component leads 36 for connection with the respective insulation displacement terminals 16 and 18. The lead clips 38 also serve to hold the electrical component 14 down in the cradle 34**.

The hollow base 26 further includes means for retaining the terminals 16 and 18 in the terminal cavities 39 comprising retainer blocks 41 that are beside each of the lead clips 38 in the respective terminal cavities 39. The terminal cavities 39 extend in opposite lateral directions with respect to the cradle 34 to receive the terminals 16 and 18 in opposite orientations as best shown in FIG. 1. Thus the retainer blocks 41 are located on opposite sides of the respective lead clips 38. These retainer blocks 41 cooperate with the hollow base 26 to retain the terminals 16 and 18 in the terminal cavities 39 as explained below.

The hollow base 26 still further includes means for supporting the electric cables 22 and 24 comprising the elevated end members **34*e* of the U-shaped cradle 34 and a pair of interior towers 42 at each end of the hollow base. Each end of the hollow base 26 has a pair of elongated slots 44 for receiving the respective electric cables 22 and 24. One of the towers 42 is at the base of each elongated slot 44. The hollow base 26 also has exterior supports 45 for the electric cables 22 and 24 at the base of each slot 44**.

Figure 4:
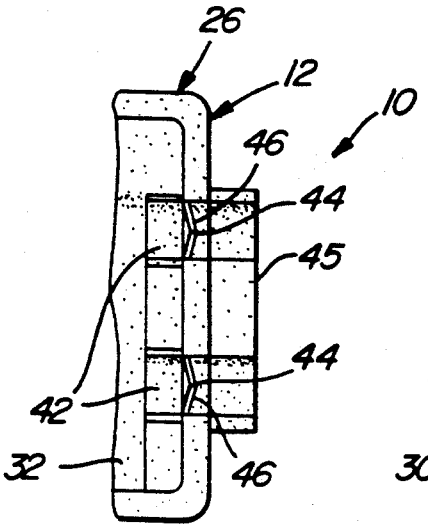
FIG. 4 is a section taken substantially along the line 4—4 of FIG. 1 looking in the direction of the arrows.

Each elongated slot 44 is closed by a thin frangible web 46 that facilitates the filling of the hollow base with the sealant material 20 while allowing the electric cables 22 and 24 to be pushed down into the elongated slots 44 for connection to the insulation displacement terminals 16 and 18 at a later time. The tops of the thin frangible webs 46 are preferably V-shaped and located below the top of the hollow base 26 by a small amount so that the webs 46 position the electric cables 22 and 24 for connection to the insulation displacement terminals 16 and 18. The thin webs 46 are frangible by virtue of a vertical slit or score line 48 which causes the thin webs 46 to split apart when the electric cables 22 and 24 are pushed down into the elongated slots 44 as shown in FIGS. 2 and 3. The thin webs 46 are also slightly V-shaped in the transverse direction and protrude outwardly as shown in FIG. 4 so that the thin webs 46 are spread apart outwardly of the hollow base 26 by the descending electric cables 22 and 24.

The hollow base 26 further includes upper and lower external nibs 50 and 52 on each side wall. The upper nibs 50 hold the cover 28 in a partially closed position as shown in FIGS. 5 and 6 while the lower nibs 52 hold the cover in the fully closed position as shown in FIGS. 2 and 3.

As indicated above, electric component package 10 includes insulation displacement terminals 16 and 18 that are housed in the hollow base 26. The insulation displacement terminals 16 and 18 are identical. Each is a U-shaped body comprising generally h-shaped end plates 54 spaced apart by laterally spaced straps 56 integrally attached at the upper end of the end plates. Each end plate 54 has parallel, laterally offset insulation displacement slots 58, 60 that open at the upper and lower ends of the plates 54 respectively. The upwardly opening slots 58 have lead-ins 62 that are shaped to receive the electric cables 22 and 24 and align their conductive cores with the narrow insulation displacement slots 58. The downwardly opening slots 60 have smaller lead-ins 64 that are shaped to receive the leads 36 of the electric component 14. The insulation displacement terminals 16 and 18 also include tangs 66 at the lower ends of the plates 54 that are disposed between the retainer blocks 41 and the walls of the hollow base 26 that define the terminal cavities 39. The tangs 66 dig into the walls of the hollow base 26 to retain the terminals 16 and 18 in the terminal cavities 39 as best shown in FIGS. 3 and 5 of the drawings.

As indicated above the identical terminals 16 and 18 are retained in the hollow base 26 in opposite orientations. Thus the insulation displacement slots 58 of terminal 16 at the one end of the hollow base 26 (the left end as viewed in FIGS. 1, 3 and 5) align with the elongated slots 44 near one side of the hollow base 26 (the rear side as viewed in FIG. 1) while the insulation displacement slots 58 of the terminal 18 at the opposite end of the hollow base 26 align with the slots 44 near the opposite side of the hollow base 26. Consequently the insulation displacement terminal 16 makes an electrical connection with the electric cable 24 when it is pushed into the rearward set of slots 44 and the insulation displacement terminal 18 makes an electrical connection with the electric cable 22 when it is pushed into the forward set of slots 44.

The cover 28 has means for engaging and pushing the electric cables 22 and 24 positioned on the hollow base 26 down into the elongated slots 44 of the hollow base 26 that comprises a pair of depending longitudinal rails 66. Opposite ends of the longitudinal rails 66 are slotted to accommodate the end plates 54 of the insulation displacement terminals 16 and 18 as the longitudinal rails 66 of the closing cover 28 pushes the electrical cables 22 and 24 into the insulation displacement slots 58. When the cover 28 is fully closed as shown in FIGS. 2 and 3, the longitudinal rails 66 cooperate with the support means (end members **34*e* and towers 42) of the hollow base 26 to hold the electric cables 22 and 24 firmly and provide a strain relief. This strain relief is enhanced by the reaction of the split webs 46** against the insulation jackets of the electric cables.

The cover 28 has large windows 68 in each side wall that accommodate the nibs 50 and 52 of the hollow base 26 and provide a lock portion 70 that cooperates with the upper nibs 50 to hold the cover in the temporary partially closed position as shown in FIGS. 5 and 6 or with the lower nibs 52 to hold the cover 28 in the fully closed position shown in FIGS. 2 and 3.

The cover 28 also has means to displace the sealant material 30 in the hollow base 26 when the cover 28 is in the fully closed position so that the fully closed housing is filled by a minimal amount of sealant material in the hollow base 26. The provides several benefits including a savings in the amount of sealant material required Further since the hollow base 26 need not be filled with the sealant material 30, the tops of the webs 46 are located and shaped to position the electrical cables 22 and 24 as indicated above and shown in FIG. 1. Moreover the tops of the terminals 16 and 18 are exposed above the sealant material 30 even when the electrical component package is partially closed as shown in FIGS. 5 and 6. Consequently the connection , polarity, and function of the electrical component 14 can be checked both before and after the application of the sealant material 30 and any time up to the attachment of the electrical component package 10 to the electric cables 22 and 24.

The means to displace the sealant material in the hollow base 26 comprises a central depending foot and outer extensions 74 of the rails 73. During closure of the cover 28, the extensions 74 engage inside the side walls of the hollow base 26 to align the cover 28 with the hollow base 26 for proper closure onto the electric cables 22 and 24 and when the cover is fully closed, the central foot 72 engages and holds the electrical component 14 down onto the cradle 34.

The sealant material 30 is preferably a dielectric silicone gel that is poured into the hollow base 26 in liquid form and then cured either by heat or ultraviolet light.

A suitable heat cured sealant material is Sylgard 527 which is a two component silicone that cures in place to form a cushioning, self-healing, resilient gel-like mass. One component may include a blue dye to facilitate handling and recognition during the manufacturing process. When this dye is added, the material is known as X3-4101. Sylgard 527 and the virtually identical X3-4101 are products of Dow Corning Corporation of Midland, Michigan.

A suitable ultravioletly cured sealant material is X3-4112 which is a single component silicone that cures in place to form a cushioning, self-healing resilient gel-like mass. This material also contains a blue dye but it changes to a yellow color when cured to facilitate handling and recognition during the manufacturing process. X3-4112 is also a product of Dow Corning Corporation.

The electrical component package 10 is assembled in the following manner. With the cover 28 in the open position as shown in FIG. 1, the electrical component 14 is first loaded into the cradle 4 of the component cavity 32 with its leads 36 being snapped into the lead clips 38 located in the terminal cavities 39 at each end of the component cavity 32. The component leads 36 are now positioned for connection to the insulation displacement terminals 16 and 18 which are then loaded into the respective terminal cavities 39 engaging the component leads 36 in the downwardly opening insulation displacement slots 60 to thereby establish electrical connections of the component leads 36 with the terminals 16 and 18.

If desired an electrical check can be made at this time. The sealant material 30 is then poured into the hollow base 26 in liquid form to partially fill the hollow base 26 as shown in FIGS. 5 and 6. The sealant material 30 is then heat or ultravioletly cured. If desired a second electrical check can be made at this time. The electrical component package 10 is now ready for field installation to the pair of electrical cables 22 and 24.

The installation is made simply by positioning the electric cables 22 and 24 on the recessed V-shaped tops of the webs 46 damming the elongated slots 44 and closing the cover 28 to push the electric cables 22 and down into the elongated slots 44 and the upwardly opening insulation displacement slots 58 of the terminals 16 and 18. The cover 28 is preferably closed in two stages. That is, the cover 28 is initially moved to the partially closed position shown in FIGS. 5 and 6 manually; and then the partially closed cover 28 is fully closed as shown in FIGS. 2 and 3 with the assistance of a tool such as a pair of pliers. When the cover 28 is fully closed, the sealant material 30 in the hollow base 26 is displaced so that the housing 12 is substantially filled with sealant material.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical component package comprising:

an electrical component having leads, an insulator housing of thermoplastic material having a hollow base and a cover, the hollow base having means supporting and locating the electrical component longitudinally in a component cavity and means holding and positioning respective leads of the electrical component in terminal cavities at opposite longitudinal ends of the component cavity inserted into downwardly opening insulation displacement slots of terminals that are subsequently assembled into the respective terminal cavities, and the terminals having upwardly opening insulation displacement slots for receiving electric cables after the terminals are assembled into the respective terminal cavities.

2. The electrical component package as defined in claim 1 wherein the means for supporting and locating the electrical component longitudinally in the component cavity comprises a generally U-shaped cradle in the bottom of the hollow base.

3. The electrical component package as defined in claim 1 wherein the hollow base further includes means for retaining the terminals in the terminal cavities.

4. The electrical component package as defined in claim 1 wherein the hollow base further includes means for supporting electric cables.

5. The electrical component package as defined in claim 1 wherein each terminal is a U-shaped body comprising generally h-shaped end plates spaced apart by laterally spaced straps integrally attached at the upper end of the end plates, each end plate having parallel, laterally offset insulation displacement slots that open at the upper and lower ends of the plates for receiving the electric cables and the electrical component leads respectively.

6. The electrical component package as defined in claim 1 wherein the cover has means for engaging and pushing electric cables down into elongated slots of the hollow base and upwardly opening insulation displacement slots of the terminals.

7. The electrical component package as defined in claim 1 wherein the means for holding and positioning the respective leads of the electrical component comprises a slotted lead clip and support that are longitudinally spaced from each other and disposed in each terminal cavity.

8. The electrical connector as defined in claim 7 wherein the means for supporting and locating the electrical component longitudinally in the component cavity comprises a generally U-shaped cradle in the bottom of the hollow base and wherein the lead clips serve to hold the electrical component in the U-shaped cradle.

9. The electrical component package as defined in claim 7 wherein the hollow base further includes means for supporting electric cables comprising elevated end portions of the U-shaped cradle and pairs of towers at each end of the hollow base.

10. The electrical component package as defined in claim 1 wherein the terminal cavities extend outwardly of the component cavity in opposite lateral directions and receive identical terminals in opposite orientations.

11. The electrical component package as defined in claim 10 wherein each end of the hollow base has a pair of elongated slots for receiving respective ones of a pair of electric cables extending through the electrical component package.

12. An electrical component package comprising:

an insulator housing of thermoplastic material having a hollow base and a cover, the hollow base having means for supporting and locating the electrical component longitudinally in a component cavity and means for holding and positioning respective leads of the electrical component in terminal cavities at opposite longitudinal ends of the component cavity for insertion into insulation displacement slots of terminals that are subsequently assembled into the respective terminal cavities, the terminal cavities extending outwardly of the component cavity in opposite lateral directions and receiving identical terminals is opposite orientations, each terminal having an upwardly opening insulation displacement slots for receiving an electric cable, each end of the hollow base having a pair of elongated slots for receiving respective ones of a pair of electric cables extending through the component package, and each of the elongated slots being closed by thin frangible webs that retain sealant material poured into the hollow base in liquid form, the thin frangible webs having V-shaped tops that are disposed below the top of the hollow base to position the electric cables for connection to the terminals, and the thin frangible webs being V-shaped in lateral section and protruding outwardly so that the tin frangible webs are pushed apart in the outward direction when the electric cables are pushed down into the elongated slots.

13. An electrical component package comprising:

an insulator housing of thermoplastic material having a hollow base and a cover, the hollow base having means for supporting and locating the electrical component longitudinally in a component cavity and means for holding and positioning respective leads of the electrical component in terminal cavities at opposite longitudinal ends of the component cavity for insertion into insulation displacement slots of terminals that are subsequently assembled into the respective terminal cavities, and the hollow base and the cover having first means to hold the cover in a partially closed position and second means to hold the cover in a fully closed position.

14. The electrical component package as defined in claim 13 wherein the cover has large windows in its side walls that accommodate upper and lower nibs of the hollow base and provide a lock portion that cooperates with the lower nibs to hold the cover in the partially closed position and with the upper nibs to hold the cover in the fully closed position.

15. The electrical component package as defined in claim 1 wherein the insulation displacement terminals are identical.

16. The electrical component package as defined in claim 15 wherein the cover has means for engaging and pushing electric cables down into the elongated slots of the hollow base and insulation displacement slots of the terminals comprising a pair of depending longitudinal rails that are slotted at opposite ends to accommodate the end plates of the terminals.

17. The electrical component package as defined in claim 16 wherein the hollow base includes means for supporting electric cables and the rails cooperate with such means of the hollow base to hold the electric cables firmly and provide a strain relief when the cover is fully closed.

18. The electrical component package as defined in claim 1 wherein the hollow base has side walls that are offset toward each other to reduce the volume of the component cavity and wherein the cover has means to displace sealant material in the hollow base when the cover is in a fully closed position so that the fully closed housing is substantially filled by a minimal amount of sealant material in the hollow base.

19. The electrical component package as defined in claim 18 wherein the means to displace the sealant material in the hollow base comprises a central depending foot of the cover and outer extensions of rails depending from the cover.

20. The electrical component package as defined in claim 19 wherein the extensions engage inside side walls of the hollow base to align the cover with the hollow base for proper closure onto electric cables and the central foot engages and holds the electrical component down in the component cavity.

* * * * *